US005588627A

United States Patent [19]

Sharpe

[11] Patent Number: 5,588,627

[45] Date of Patent: Dec. 31, 1996

[54] PAPER ROLLER

[75] Inventor: Norton Sharpe, Los Angeles, Calif.

[73] Assignee: Franklin Brass Manufacturing Company, Rancho Dominguez, Calif.

[21] Appl. No.: 530,482

[22] Filed: Sep. 19, 1995

[51] Int. Cl.[6] ..... B65H 75/02

[52] U.S. Cl. ..... 242/599

[58] Field of Search ..... 242/599, 599.1, 242/599.2, 599.3, 613, 613.1, 613.2, 613.5; D6/515–523

[56] References Cited

U.S. PATENT DOCUMENTS

| | | | |
|---|---|---|---|
| 1,674,28 | 6/1928 | Harvey . | |
| D. 291,518 | 8/1987 | Chap . | |
| D. 296,963 | 8/1988 | Smallwood . | |
| D. 324,618 | 3/1992 | Morand . | |
| D. 325,486 | 4/1992 | Goldstein . | |
| D. 355,319 | 2/1995 | Ng . | |
| 3,051,404 | 8/1962 | Ritchey | 242/599.3 |
| 3,140,059 | 7/1964 | Lusebrink | 242/599 |
| 3,180,586 | 4/1965 | Caravella . | |
| 3,788,573 | 1/1974 | Thomson et al. . | |
| 4,191,342 | 3/1980 | Reinhold . | |
| 5,292,083 | 3/1994 | Ridenour | 242/599 |

FOREIGN PATENT DOCUMENTS

| | | | |
|---|---|---|---|
| 666161 | 2/1952 | United Kingdom | 242/599 |

OTHER PUBLICATIONS

U.S. patent application Ser. No. 29/043,270, filed Aug. 30, 1995, now allowed.

Xerographic copy of a picture of a compressible cover for a bicycle axle. A third party has informed applicant's attorney that this cover was on sale at least before Sep. 19, 1994.

Xerographic picture of a compressible cover for a bicycle axle.

Multiple diaphragm spring, No. 12 of *Practical Pictorial Guide to Mechanisms and Machines* by Simon S. Palestrant, University Books, New York, pp. 108–109, 1956.

*Primary Examiner*—John P. Darling

*Attorney, Agent, or Firm*—Loeb & Loeb LLP

[57] ABSTRACT

A paper roller having at least two pleated portions separated by a cylindrical portion. Each pleated portion comprises an accordion-shaped structure to facilitate installation of the roller in a bracket.

10 Claims, 2 Drawing Sheets

PAPER ROLLER

BACKGROUND OF THE INVENTION

1. Field of the Invention

This invention relates generally to supports for carrying rolls of sheet material, and more particularly, a paper roll support for carrying rolls of toilet paper or the like.

2. Related Art

Typically, a paper roller, or support, includes two tubular halves, wherein one half telescopically slides inside the other half. A compression spring within the two halves permits the support to be compressed when being removed or inserted into a toilet paper holder. Thus, conventional paper rollers typically have a minimum of three separate parts including the two telescoping tubular end pieces and the spring in the middle biasing the end pieces apart.

Other paper rollers are constructed to be part of the toilet paper holder itself and cannot be removed. Therefore, these paper rollers are generally not compatible with conventional paper roll holders in widespread use today.

SUMMARY OF THE DISCLOSURE

It is an object of an embodiment of the present invention to provide an improved paper roller, which obviates for practical purposes, the above mentioned limitations of traditional paper rollers.

A paper roller according to a preferred embodiment includes, generally, a single, flexible tubular member independent of the paper roll holder. Since the paper roller is manufactured as a single part, no assembly of parts is required. Furthermore, the paper roller of the invention is compatible with existing conventional paper roll holders.

In a preferred embodiment of the present invention, a wall of the tubular member has at least one pleated portion adjacent an end of the tubular member. The pleated portion comprises an accordion-shaped structure which acts as a spring to facilitate insertion of the roller into and removal of the roller from the paper roll holder.

BRIEF DESCRIPTION OF THE DRAWINGS

Other features and advantages of the invention will become apparent from the following detailed description, taken in conjunction with the accompanying drawings which illustrate, by way of example, the various features of embodiments of the invention and in which.

DETAILED DESCRIPTION OF THE PREFERRED EMBODIMENT

Figure 1:
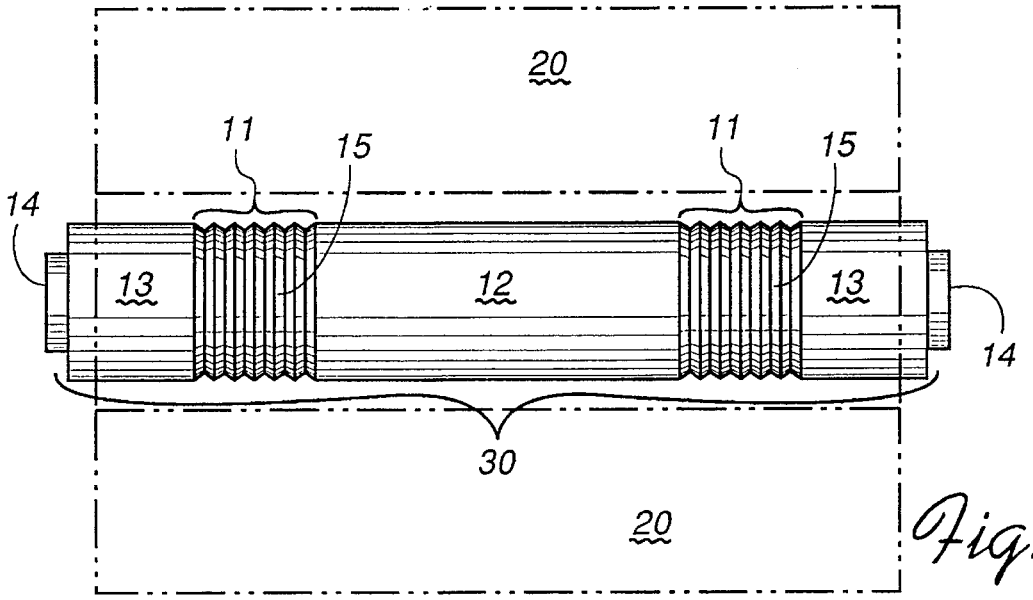
FIG. 1 is a schematic plan view of a paper roller in accordance with a preferred embodiment of the present invention.

As shown in the drawings for purposes of illustration, the invention is embodied in a toilet paper roller or support. However, it should be recognized that roller of the invention can be used to support other rolls of continuous sheet material such as paper towels.

Figure 2:
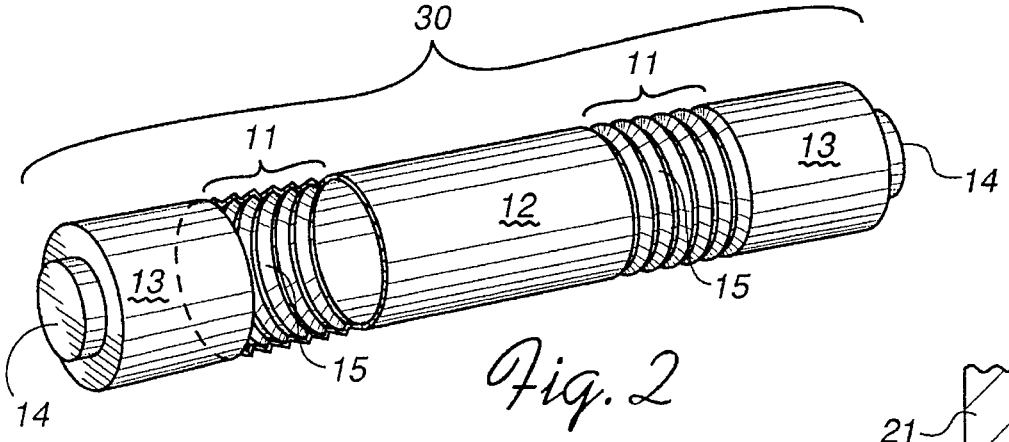
FIG. 2 is a perspective view of the support of FIG. 1 shown with a portion broken away.
Figure 3A:
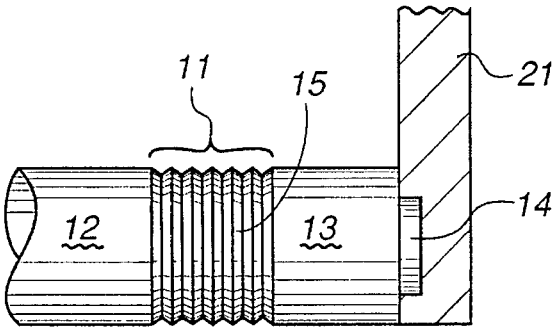
FIG. 3(*a*) and 3(*b*) are close-up views of the support of FIG. 1, interacting with a toilet paper bracket of a toilet paper holder.
Figure 3B:
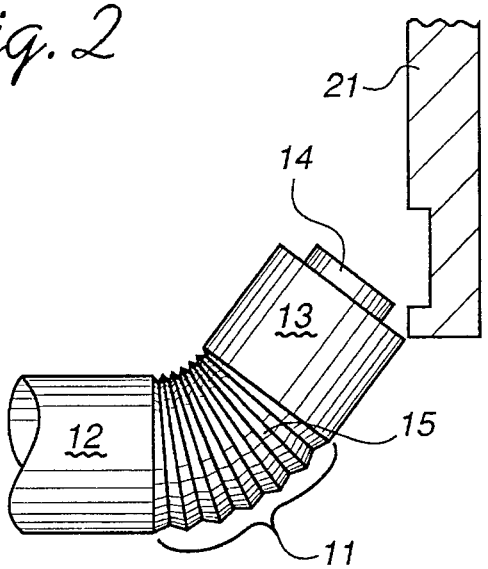
Figure 4:
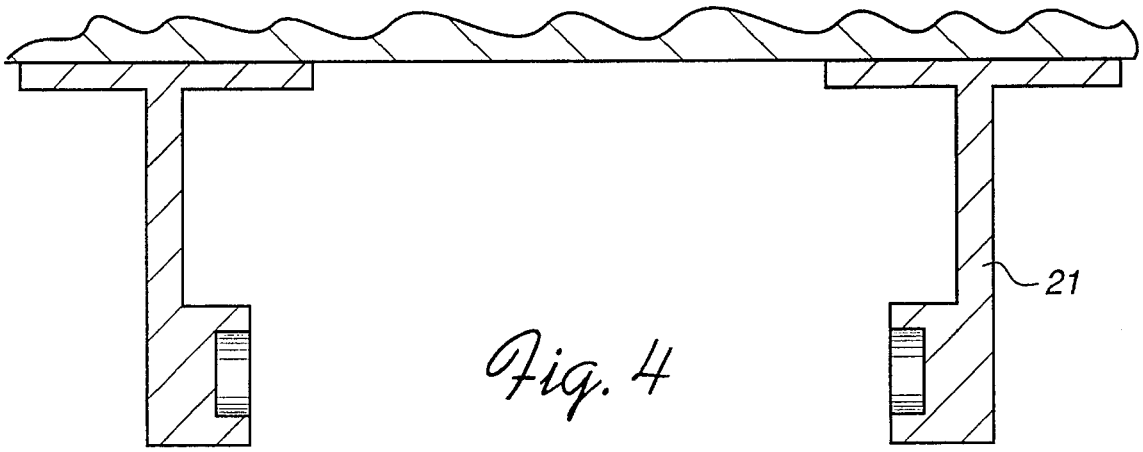
FIG. 4 is a top view of a pair of associated toilet paper brackets of a toilet paper holder.
Figure 5:
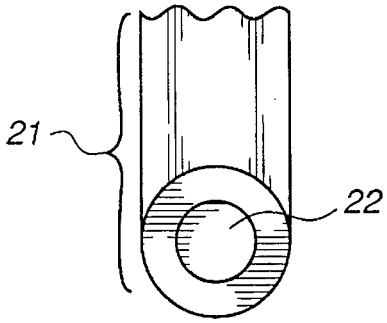
FIG. 5 is an end interior view of a toilet paper bracket of FIG. 4.

FIGS. 1 and 2 show a toilet paper roller 30 employed for supporting a conventional roll of toilet paper 20. The toilet paper roller 30, is a tubular structure and, in accordance with a preferred embodiment of the invention, the wall of the roller 30 has two accordion-like pleated portions 11 comprised of a series of conically-shaped structures or individual pleats 15 that serve as spring coils. Furthermore, the toilet paper roller 30 has, at each end, a projection 14 shaped to conform to and adapted to be received by an associated bracket cavity 22 of a toilet paper holder or dispenser. The flexibility of pleated portion 11 allows the end supports 14 to be inserted or removed from the associated bracket cavity 22. FIG. 3(*b*) best illustrates the flexibility of pleated portion 11. Additionally, once the toilet paper roller is inserted into the conventional toilet paper brackets 21 as shown in FIG. 3(*a*), the pleated portion 11 biases the end projections 14 toward the bracket cavity 22 of the conventional toilet paper bracket 21, to keep the toilet paper roller 30 in place.

Furthermore, a non-pleated connector segment 13 connects each pleated portion 11 with one of the end projections 14, and a central, non-pleated connector segment 12 connects both pleated portions 11. The length of the connector segments 13 should be long enough for the roll of toilet paper 20 to rest partially on the connector segment 13 at each side of the paper roller 30. The length of connector segment 12 is determined by the distance between a pair of the toilet paper brackets 21 and the number of pleats 15 in the pleated portion 11. In accordance with a preferred embodiment of the invention, each pleated portion has four pleats but a range of two (2) to six (6) pleats is also useful.

One advantage of the toilet paper roller 30 is that the toilet paper roll 30 can be manufactured as a single piece. No assembly is required. Unlike conventional toilet paper rollers, the toilet paper roll 30 does not require assembly of three components which can become separated. Additionally, fewer parts can reduce manufacturing costs.

In a preferred embodiment, the toilet paper roller 30 is molded from a relatively thin, flexible, sheet material of polyethylene or polypropylene which is abrasion resistant, water resistant, and chemically stable. The thickness of the walls of the roller may vary depending upon the application, but a thickness range of 1–30 mm is preferred. Thus, the toilet paper roller 30 is preferably hollow making it lightweight, floatable and easy to compress. The roller 30 may be molded in two halves which are then joined to form a single integral piece. The end projection 14 may be closed or alternatively may define an aperture if access to the interior of the roller is desired.

While the description above refers to particular embodiments of the present invention, it should be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive. The scope of the invention is therefore indicated by the appended claims, rather than the foregoing description, and all changes which come within the meaning and range of equivalency of the claims are therefore intended to be embraced therein.

What is claimed is:

1. A paper roll support for use with a pair of supporting brackets having cylindrically-shaped cavities for receiving an end of the support, said support comprising:

a generally tubular unitary member independent from the brackets, wherein the tubular member comprises at least two flexible pleated portions and a cylindrical portion positioned between the pleated portions.

2. A paper roll support apparatus according to claim 1, wherein said pleated portions each comprise alternating spring portions wherein each alternating spring portion has an outer diameter which is the same as the outer diameter of said cylindrical portion.

3. A paper roll support apparatus according to claim 1, wherein each pleated portion comprises a plurality of conically-shaped spring portions.

4. A paper roll support apparatus according to claim 1, wherein each pleated portion is adjacent to an associated end of the support.

5. A paper roll support apparatus according to claim 1, wherein the cylindrical member is fabricated of one of polyethylene or polypropylene.

6. A paper roll support for use with a pair of supporting brackets having cylindrically-shaped cavities for receiving an end of a support, said support comprising:

a longitudinally compressible member having opposed ends, wherein the compressible member comprises at least two conically-shaped spring portions and a cylindrical portion between the spring portions.

7. A paper roll support for use with a pair of supporting brackets having cylindrically-shaped cavities for receiving an end of a support, said support comprising:

a generally cylindrically-shaped unitary member having two ends wherein the unitary member comprises at least two pleated portions and a cylindrical portion between the pleated portions and wherein said pleated portions further form a flexible spring.

8. A paper roll support for use with a pair of supporting brackets having cylindrically-shaped cavities for receiving an end of a support, said support comprising:

a hollow, generally cylindrically-shaped unitary member, said member having at each end a knob, shaped to conform to and adapted to be received by an associated bracket cavity, said unitary member further comprising a cylindrical portion and at least two pleated portions wherein the cylindrical portion separates the pleated portions and said pleated portions further form a flexible spring which facilitates bending the end of the member.

9. A paper roll support apparatus according to claim 8, wherein the unitary member is formed of a flexible plastic material.

10. A method of installing a paper roll support in a pair of supporting brackets having cavities comprising:

flexing a first pleated portion adjacent one end of a support member to insert a first trunnion of the support member into a cavity; and flexing a second pleated portion of the support member adjacent the opposite end of the support member and separate from the first pleated portion in order to insert a second trunnion of the support member into a cavity of a separate bracket.

* * * * *